US009878514B2

(12) United States Patent
Saiia

(10) Patent No.: US 9,878,514 B2
(45) Date of Patent: Jan. 30, 2018

(54) APPARATUS AND METHOD FOR PRODUCING A THATCH ROOFING MATERIAL FOR BUILDING CONSTRUCTION

(71) Applicant: David Saiia, Pittsburgh, PA (US)

(72) Inventor: David Saiia, Pittsburgh, PA (US)

( * ) Notice: Subject to any disclaimer, the term of this patent is extended or adjusted under 35 U.S.C. 154(b) by 1070 days.

(21) Appl. No.: 13/834,536

(22) Filed: Mar. 15, 2013

(65) Prior Publication Data

US 2013/0203578 A1 Aug. 8, 2013

Related U.S. Application Data

(63) Continuation-in-part of application No. 12/757,007, filed on Apr. 8, 2010, now Pat. No. 8,425,390.

(51) Int. Cl.

| | |
|---|---|
| ***B26D 3/11*** | (2006.01) |
| ***E04D 9/00*** | (2006.01) |
| ***B31F 5/00*** | (2006.01) |
| *B26D 1/04* | (2006.01) |
| *B26D 5/10* | (2006.01) |

(52) U.S. Cl.

CPC ..... *B31F 5/005* (2013.01); *B26D 3/11* (2013.01); *E04D 9/00* (2013.01); *B26D 1/04* (2013.01); *B26D 5/10* (2013.01)

(58) Field of Classification Search

None

See application file for complete search history.

(56) References Cited

U.S. PATENT DOCUMENTS

| | | | | |
|---|---|---|---|---|
| 2,171,010 A | | 8/1939 | Schuetz et al. | |
| 4,319,938 A | * | 3/1982 | Vives | B21C 37/083 156/159 |
| 4,611,451 A | | 9/1986 | Symbold | |
| 4,830,599 A | * | 5/1989 | Okusau | B29C 51/30 156/245 |

(Continued)

FOREIGN PATENT DOCUMENTS

CA 1100400 A1 5/1981

OTHER PUBLICATIONS

"Hand Crank Apple Peeler" User Manual, Revision 09k, publication date unknown, retrieved Apr. 7, 2010 from www.harborfreight.com.

(Continued)

*Primary Examiner* — Barbara J Musser

(74) *Attorney, Agent, or Firm* — Quarles & Brady LLP

(57) ABSTRACT

To produce a thatch roofing material from waste plastic bottles, an apparatus includes a device for cutting the bottles into one or more strips. The device may include a decontouring unit that removes contours from the bottles and a heated clamp that fuses the strips together lengthwise to create a plastic tape. A bottle may be formed into rectangular stock by removing the top and bottom and longitudinally cutting the middle part. The rectangular stock may be cut into the cut strips, such as with a wire cutter. The plastic tape may be used to create folded thatch components by cutting, from the plastic tape, one or more slats and one or more thatch roofing material strips, and folding and attaching the thatching roofing material strips to the slats. Serrated ties may be cut from the plastic tape and used to fasten the folded thatch components to a building structure.

13 Claims, 11 Drawing Sheets

(56) References Cited

U.S. PATENT DOCUMENTS

| | | | | |
|---|---|---|---|---|
| 5,512,233 | A * | 4/1996 | Gallagher | B29C 37/0032 156/245 |
| 6,226,949 | B1 | 5/2001 | Huber | |
| 6,446,697 | B1 * | 9/2002 | Shaikh | G05B 19/4099 164/35 |
| 7,117,652 | B2 | 10/2006 | Huber et al. | |
| 7,520,370 | B2 | 4/2009 | Gudim | |
| 2002/0116951 | A1 * | 8/2002 | Dunifon | C03B 23/0307 65/106 |

OTHER PUBLICATIONS

"Lathe," Wikipedia, retrieved Apr. 6, 2010 from en.wikipedia.org/wiki/Lathe.

* cited by examiner

APPARATUS AND METHOD FOR PRODUCING A THATCH ROOFING MATERIAL FOR BUILDING CONSTRUCTION

FIELD OF THE DISCLOSURE

Embodiments of the present invention generally relate to thatch roofing material and, more particularly, to an apparatus and method for producing a thatch roofing material from waste plastic for building construction.

BACKGROUND

Over many generations, thatch roofing has been used to construct shelter over buildings and other structures. The type of thatch roofing utilized often varies from one region to another. In some regions, the roofing is typically formed of grasses or palm fronds which present a generally loose or random appearance, while thatch roofing in other regions is typically formed of straw and/or reeds.

Conventionally, thatch is made from natural constituents such as straw, grasses, reeds, palm leaves or the like. In recent times thatch can be made from artificial or synthetic elements, which are formed to present the appearance of natural thatch material, but are very expensive at initial installation. Notably, natural thatch is typically highly combustible, and consequently must be heavily treated to pass building codes in various jurisdictions or it is not allowed. Natural thatch is also very susceptible to rotting and degradation due to high humidity and moisture, and presents natural nesting material for insects, vermin and birds. Moreover, the natural thatching requires replacement and constant maintenance due to the phenomena of rotting. In natural thatching, multiple layers of materials are necessary to form a water impermeable covering. Consequently, the exposed ends or faces of the thatch elements along the eaves of the roof are relatively thick. Further, the rotting exposed ends indicate that the roof is susceptible to leakage or other malfunction. Furthermore, natural thatching requires skilled artisans for the construction of the individual thatch members and for the installation of the roof. Natural thatching is expensive in modern times due to increased demand for food crops which competes for land area upon which thatch can be grown.

Subsequently, the development of synthetic or artificial thatching has obviated some of the problems. The artificial thatching is disposed on the roof to form a waterproof surface. Corrugated tin, fiber-glass, or sheet plastic has been extensively used as a substitute roofing material, but this solution creates a stifling hot internal house environment when applied in tropical climates. However, using waste-plastic bottles to create a plastic thatching fills the need for a cost effective, easy to install, effective and comfortable roofing solution. Moreover, used plastic bottles are fast exhausting land-fill all over the world, which is a serious concern as there are few other affordable and safe methods to dispose of such waste. In places where there are no land-fill areas this waste creates several problems in the natural environment, for example from litter inhibiting plant growth, to inadvertent ingestion by land and sea animals, as well as other problems. Finally, the translucent plastic thatch described herein allows for ample day-lighting within the structure.

Therefore, there is a need in the art for an apparatus and method for producing a thatch roofing material for building construction from waste material, which provides protection from rain water, comfort from the heat of the day, day-lighting opportunities, and helps to reduce the amount of waste sent to landfills.

SUMMARY OF THE DISCLOSURE

Embodiments of the present invention generally include an apparatus and method for producing a thatch roofing material from waste-plastic bottles for building construction. In one embodiment, an apparatus for producing a thatch roofing material from waste-plastic bottles for building construction includes a pair of stanchions, a supporting frame operably coupled to the pair of stanchions via one or more fasteners, at least one holding member operably coupled to each stanchion of the pair of stanchions for holding a container, a first shaft extending substantially perpendicular to each stanchion of the pair of stanchions, the first shaft being coupled to each stanchion of the pair of stanchions and a blade coupled to the first shaft for cutting the container.

In another embodiment, an apparatus for producing a thatch roofing material for building construction comprises a heated clamp configured to fuse together a first strip and a second strip each being cut from a waste plastic bottle, the heated clamp comprising: a top plate comprising: a body having a bottom surface; a projection extending from the bottom surface of the body, the projection having a substantially planar contact surface; and a heating element positioned to heat at least the contact surface; and a bottom plate disposed a distance below the top plate, the bottom plate comprising: a body having a top surface; and a recess disposed in the top surface of the body and configured to receive the projection of the top plate, the recess having a substantially planar contact surface that approximates the size of the contact surface of the top plate.

In one embodiment, a method of producing a thatch roofing material for building construction includes the steps of forming a container assembly by inserting a casting member into a container to form a container assembly, positioning the container assembly between a housing member of at least one holding member and a support projection member of at least one holding member, cutting the container to obtain the thatching material and creating a counter bend on the thatching material to obtain an evenly surfaced and "un-spiraled" thatching material.

In another embodiment, a method of producing a plastic thatch roofing material for building construction comprises cutting one or more waste plastic bottles into one or more cut strips each having a proximal end and a distal end; and fusing the cut strips together lengthwise to form a plastic tape from which may be cut a plurality of thatch roofing materials strips and one or more slats.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective and more efficient embodiments.

DETAILED DESCRIPTION OF THE DISCLOSURE

Figure 1:
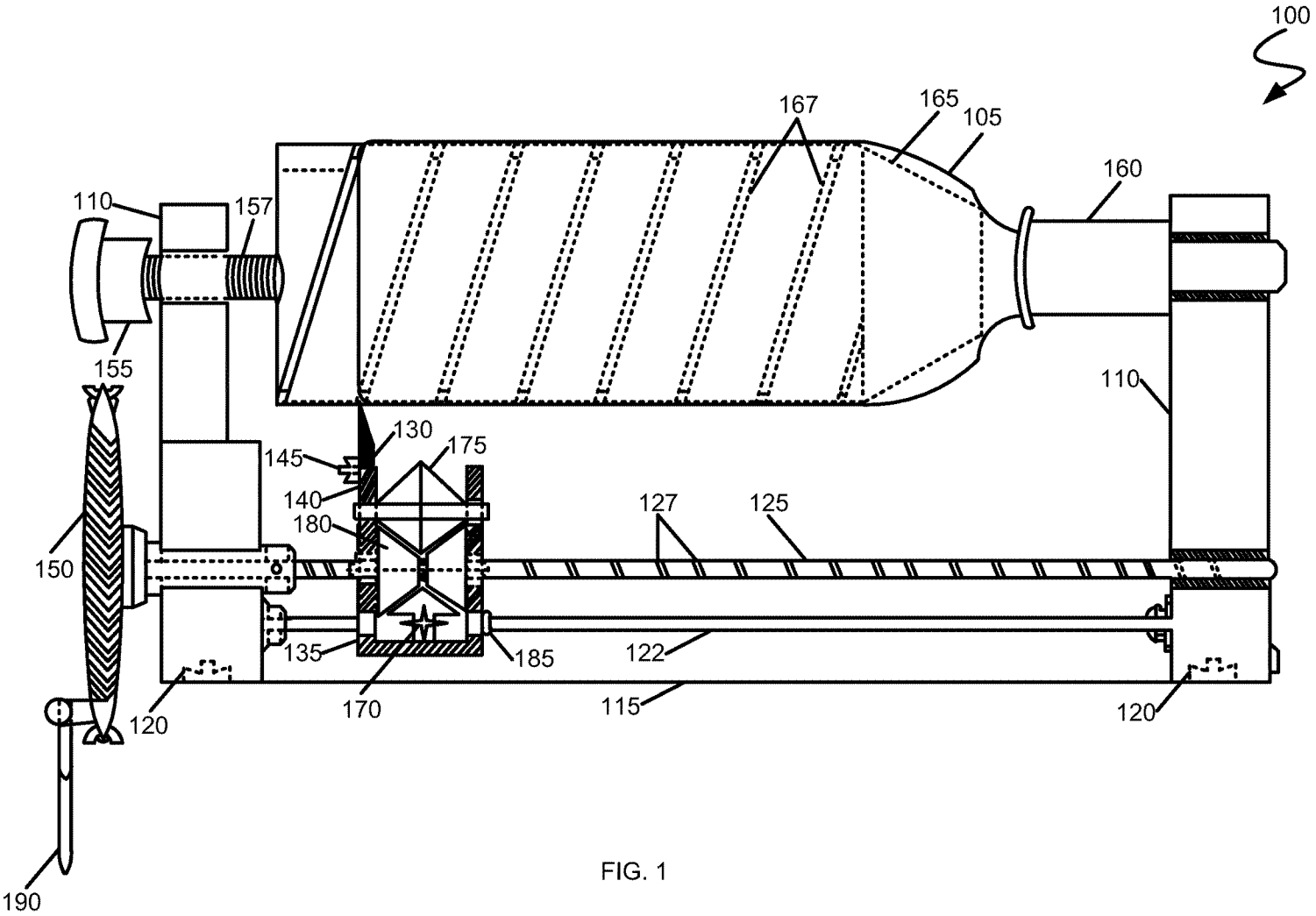
FIG. 1 illustrates a schematic front elevation view of an apparatus for producing a thatch roofing material for building construction, according to an embodiment of the present disclosure.

FIG. 1 illustrates a schematic front elevation view of an apparatus 100 for producing a thatch roofing material for building construction, according to an embodiment of the present invention. The apparatus 100 for converting a container 105 into the thatch roofing material for building construction includes a pair of stanchions 110, a supporting frame 115 operably coupled to the pair of stanchions 110 via one or more fasteners 120, at least one holding member operably coupled to each stanchion of the pair of stanchions 110 for holding the container 105, a first shaft 125 extending substantially perpendicular to the each stanchion of the pair of stanchions 110, a blade 130 coupled to the first shaft 125 for cutting the container 105, a carriage 135 for operably coupling the blade 130 to the first shaft 125, a vertical securing member 140, a rotatable crank member, a casting member 165, and a pair of rollers. The pair of rollers includes a first roller 175, and a second roller 180.

In operation, the pair of stanchions 110 is parallely spaced apart and secured at both ends of the supporting frame 115 via one or more fasteners 120. The first shaft 125 is coupled to the each stanchion of the pair of stanchions 110. The carriage 135 operably couples the blade 130 to the first shaft 125. The blade 130 extends vertically upwards from the first shaft 125. However, the blade 130 is an adjustable blade. Moreover, the vertical securing member 140 defines a fore opening for coupling the adjustable blade 130 to the carriage 135. The adjustable blade 130 is disposed inside the vertical securing member 140. Generally, the vertical securing member 140 includes one or more latches 145 for adjusting a position of the adjustable blade 130. The latch 145 adjusts the position of the blade 130 in upward or downward direction according to the dimension of the container 105 and corresponding width of the casting member 165. The at least one holding member includes a housing member 160 and a support projection member 155. The support projection member 155 has a threaded portion 157. Further, the housing member 160 includes a spring element (not shown) to aid in the securing and release of the casting member 165.

In one embodiment of the present invention, the casting member 165 is configured for being inserted into the container 105 to form a container assembly. In operation, a proximal end of the casting member 165 is inserted into the housing member 160. The spring element of the housing member 160 is configured for securely holding the casting member 165 in place with respect to the positioning of the blade 130. A distal end of the casting member 165 having a threaded bore (not shown) thereon is threadably engaged to the threaded portion 157 of the support projection member 155. The support projection member 155 secures the position of the casting member 165 along with the housing member 160 with respect to the positioning of the blade 130. The dimension of the support projection member 155 may vary according to the size of the casting member 165 and the container 105 utilized in the present invention. The employment of different dimensions of the support projection member 155 in the present invention provides the utilization of different sizes of the container 105. For example, the container 105 may be a used cold drink bottle, a milk jug, a juice bottle and the like. Particularly, the container 105 may be any waste plastic bottle available in the art.

In one embodiment of the present invention, the crank member includes a rotatable crank wheel 150. In response to a rotation of the rotatable crank wheel 150 the carriage 135 moves along the first shaft 125. The first shaft 125 is pivotally connected to the crank wheel 150. The driving mechanism for rotating the first shaft 125 is executed by turning the crank wheel 150. The turning of the crank wheel 150 rotates the first shaft 125 having a threaded pattern 127. The threaded pattern 127 of the first shaft 125 during rotation provides sideward motion to the blade 130 for the cutting of the container 105 placed over the casting member 165.

In one embodiment of the present invention, the casting member 165 has a spiral channel 167 engraved over its surface and the blade 130 is configured to navigate over the spiral channel 167 along the container assembly for cutting the container 105 into a predetermined spiral strip. Particularly, the casting member 165 predetermines the width of the spiral strip cut from the container 105. The blade 130 is configured to navigate over the spiral channel 167 for cutting the container 105 positioned over the casting member 165 via the rotation of the threaded pattern 127 of the first shaft 125. Subsequently, the cut spiral strip material from the container 105 is introduced to the pair of rollers and drawn through the first roller 175 under pressure against the second roller 180. The cut spiral strip material may be guided from the casting member 165 to the pair of rollers by the natural bend of the material or by hand. Alternatively, the cut spiral strip material may be removed from the casting member 165 and subsequently fed into the pair of rollers by hand. The rotation of the threaded pattern 127 of the first shaft 125 provides the mechanical motion driving the blade 130 for the cutting of the container 105 and also for driving the first roller 175 and the second roller 180 respectively. The threaded pattern 127 of the first shaft 125 is rotated by turning of the crank wheel 150. However, the present invention is not limited to the employment of the crank wheel 150 and the first shaft 125 may be rotated by any other mechanism and/or engine available in the art.

In one embodiment of the present invention, the carriage 135 is positioned at an angle of about 30 degree to the spiral channel 167 of the casting member 165 of the container assembly to facilitate smooth drawing of the thatching material from the container 105.

In another embodiment of the present invention, for preparing wider multiple strips for a top binding unit of a thatch, the casting member 165 has a wider spiral channel 167 engraved over the surface of the casting member 165. Similarly, for preparing narrow multiple strips for the top binding unit of the thatch, the casting member 165 has a narrow spiral channel 167 engraved over the surface of the casting member 165.

In one embodiment of the present invention, the apparatus 100 further includes a friction generator 170. The friction generator 170 is configured to provide heat to the first roller 175 and the second roller 180. The first roller 175, the second roller 180 and the friction generator 170 are disposed inside the carriage 135. The first roller 175, the second roller 180 and the friction generator 170 extend transversely across each stanchion of the pair of stanchions 110. The first roller 175 is configured for receiving the thatching material cut from the container assembly via the blade 130. Particularly, the incised cut thatching material is inserted between the first roller 175 and the second roller 180. The second roller 180 includes a recess (not shown) through which the first shaft 125 passes through. The second roller 180 is configured for creating a counter bend on the thatching material to obtain an even and straightened surface in the thatching material by the driving power source provided by rotating the rotatable crank wheel 150. The second roller 180 further puts a crease in the thatching material against a curve of the thatching material to flatten the thatching material strip. The rotatable crank wheel 150 rotates the first shaft 125 having the threaded pattern 127. Particularly, the threaded pattern 127 of the first shaft 125 during rotation provides the driving power source for the rotary motion of the first roller 175 and the second roller 180. The counter bend created by the second roller 180 on the incised thatching material removes the curves out from spiral strip cut from the container 105 to obtain the even surface thatching material. Particularly, the first roller 175 and the second roller 180 which are heated by the friction generator 170 facilitates deformation of the obtained thatching material making it a more pliable and smooth material. However, the heat provided by the friction generator 170 may be regulated to provide optimum temperature according to type of plastic material utilized in the present invention. The first roller 175 is a convex roller. The second roller 180 is a concave roller configured for rotating around the first shaft 125. Further, the apparatus 100 includes a second shaft 122 extending substantially perpendicular to the each stanchion of the pair of stanchions 110.

In one embodiment of the present invention, the first roller 175 and the second roller 180 are metal rollers, rubber rollers, conglomerate rollers and the like. However, the first roller 175 and the second roller 180 may be made of other appropriate materials available in the art and machined in such a way that any width of the cut plastic material may be employed, thereby removing the curves out of the cut plastic spirals, and forming the even surface thatching material.

In another embodiment of the present invention, the first roller 175 and the second roller 180 are provided with a surface made of a material such as an elastic rubber or polyurethane. The rubber material serves the purpose of allowing the incised thatching material to form even surface and removing the curves out from the thatching material. The rubber or polyurethane surface permits a greater range of adjustment for providing a better even surface thatching material. Moreover, the rubber or the polyurethane surface adjusts the variations of the incised thatching material thickness.

In operation, the carriage 135 is positioned in two or more positions. The two positions in which the carriage 135 is positioned include a cutting position and a creasing position. The carriage 135 is configured in the cutting position for sliding over the first shaft 125 for cutting the container 105 by moving the blade 130 over the container assembly. The blade 130 is configured to navigate over the spiral channel 167 of the casting member 165 for cutting the container 105 positioned over the casting member 165 via the rotation of the threaded pattern 127 of the first shaft 125. The rotation of the threaded pattern 127 of the first shaft 125 provides the sideward motion to the blade 130 for the cutting of the container 105. The threaded pattern 127 of the first shaft 125 is rotated by turning of the crank wheel 150. The carriage 135 includes a locking member 185 for fastening the carriage 135 onto the second shaft 122. The second shaft 122 provides support to the blade 130 disposed in the carriage 135 as it navigates over the spiral channel 167 of the casting member 165 for cutting the container 105 positioned over the casting member 165. Further, the second shaft 122 also provides support to the first roller 175 and the second roller 180 disposed in the carriage 135.

In another embodiment of the present invention, the carriage 135 is configured in the creasing position by elevating and positioning the carriage 135 by fastening to the support projection member 155 of the holding member via the locking member 185 of the carriage 135. However, the locking member 185 of the carriage 135 is disengaged from the second shaft 122 before elevating and positioning the carriage 135 in the creasing position.

In one embodiment of the present invention, the crank wheel 150 is swiveled by a drive bar 190 connected to a treadle-type foot pedal (not shown). The present invention is not limited to employing the treadle-type foot pedal for providing driving power to the crank wheel 150 for rotating the first shaft 125. In other situations, a power motor may be employed in which a chain drive is positioned on the crank wheel 150 or any other mechanism may be employed to provide power to the crank wheel 150 for rotating the first shaft 125 available in the art. Also, the particular drive unit described above is given by way of example only and various modifications will be apparent to persons skilled in the art without departing from the scope of the present invention. For example, the crank wheel 150 could be replaced by a lever arm.

Figure 2A:
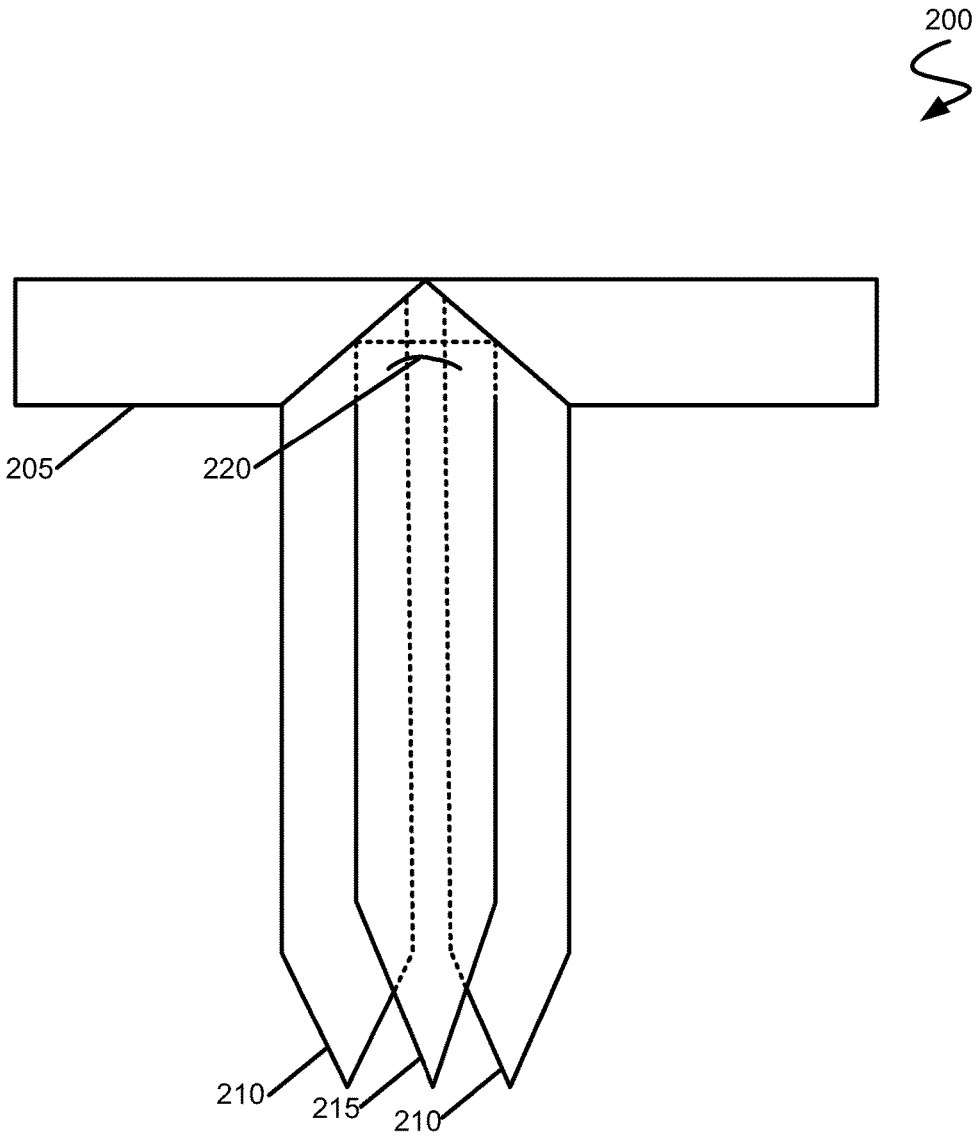
FIG. 2A illustrates a schematic top view of a folded thatch component made from a thatch roofing material strips and mounted on a slat, according to one embodiment of the present disclosure.
Figure 2B:
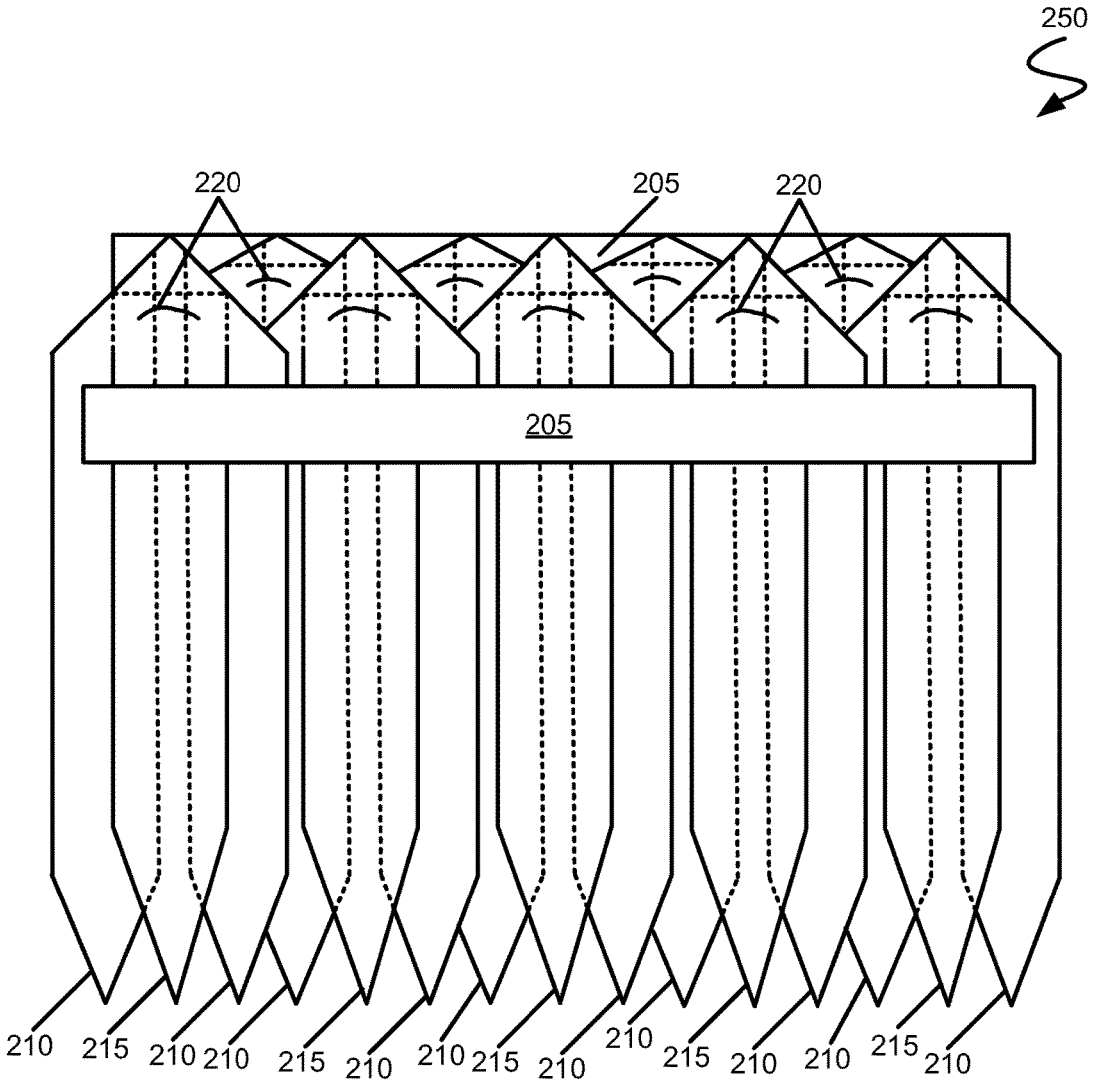
FIG. 2B illustrates a schematic top view of two layers of a thatch element construction made from multiple thatch roofing material strips, according to one embodiment of the present disclosure.
Figure 3:
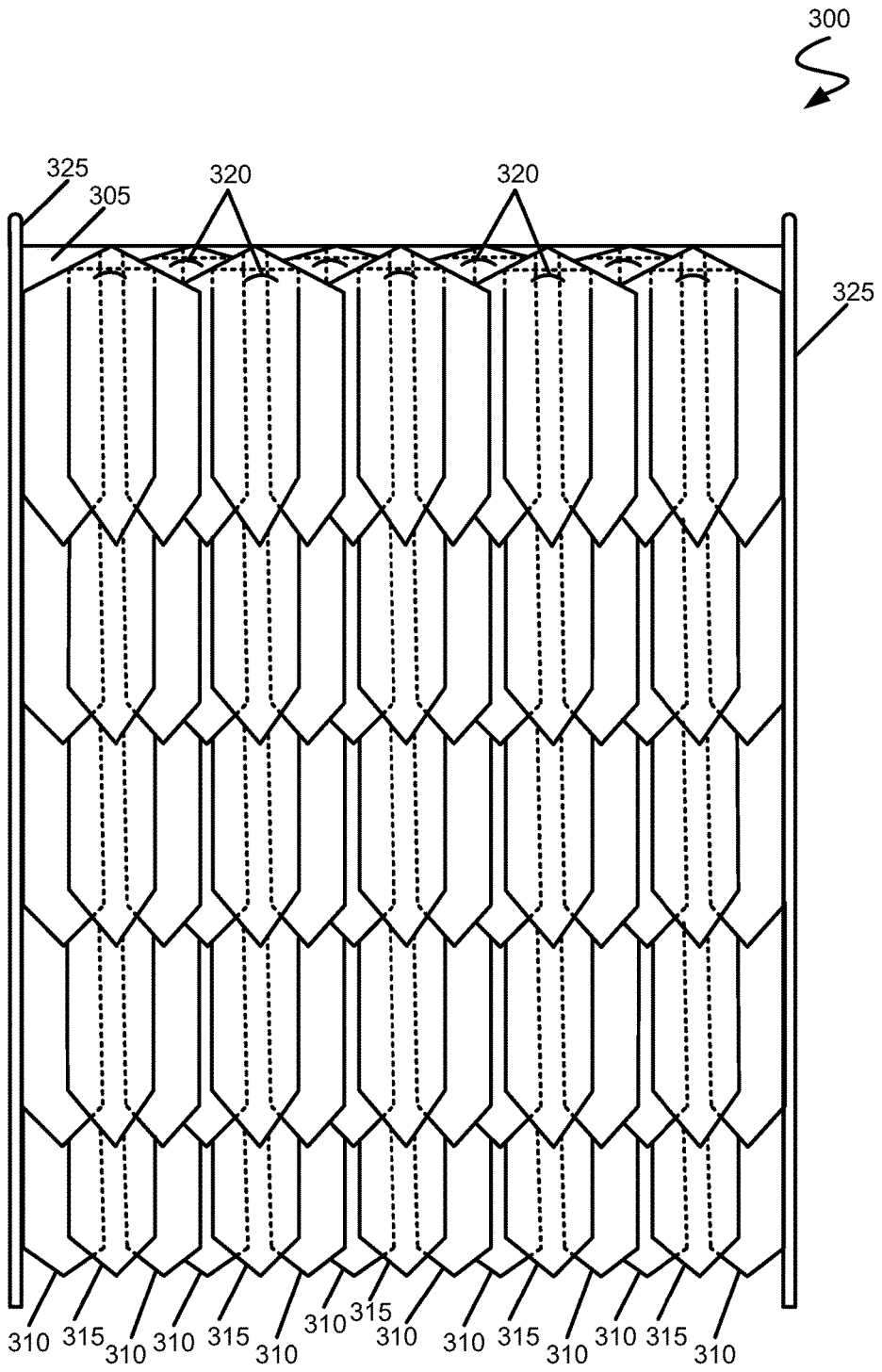
FIG. 3 illustrates a schematic front view of a thatch panel made from the multiple thatch roofing material strips, according to one embodiment of the present disclosure.

FIG. 2A illustrates a schematic top view of a folded thatch component 200 made from a thatch roofing material strips 210, 215 and mounted on a slat 205, FIG. 2B illustrates a schematic top view of two layers of a thatch element construction 250 made from multiple thatch roofing material strips 210, 215, and FIG. 3 illustrates a schematic front view of a thatch panel 300 made from the multiple thatch roofing material strips 310, 315, according to one embodiment of the present invention. The thatch roofing material strip 210 is folded to form a triangular slot as illustrated in the FIG. 2A. The thatch roofing material strip 215 is placed in the triangular slot formed by the thatch roofing material strip 210. Particularly, the thatch roofing materials 215, 210 are securely held together to the slat 205 via a binder 220 which forms the folded thatch component 200. Each folded thatch component 200 is placed adjacent to the previous folded thatch component 200 on the slat 205 until the entire slat 205 is covered with multiple folded thatch components 200 to form a first layer of the thatch element construction 250 as illustrated in the FIG. 2B. Subsequently, a second layer of the thatch element construction 250 is made by placing the multiple folded thatch components 200 in one or more fissures available in the first layer of the thatch element construction 250. The first layer and the second layer form the two layers of the thatch element construction 250 as illustrated in the FIG. 2B. The folded thatch component 200 having the thatch roofing materials 215, 210 are held together to the slat 205 via the binder 220. Particularly an additional slat 205 is positioned over the binders 220 of the second layer of the thatch element construction 250 to fasten the thatch element construction to a roof (not shown). The thatch element construction 250 made by employing the thatch roofing materials 215, 210 of the present invention have a more natural appearance than prior art thatch element constructions. Examples of thatch element constructions include, but are not limited to, panels for walls or awnings, roof shingles, coverings and the like.

In one embodiment of the present invention, the binder 220 is a fastener. The fastener may be a metal element or any other element which suffice the objectives of the present invention such as nail guns or staples or other techniques available in the art. The thatch roofing materials 215, 210 may have tapered ends. The thatch roofing materials 215, 210 are the cut strips of the container 105 (of FIG. 1).

In one embodiment of the present invention, the slat 205 is a bamboo slat.

In another embodiment of the present invention, an aperture (not shown) is made on each folded thatch component 200 having the thatch roofing material strips 210, 215. Through the aperture of the each folded thatch component 200, a suture (not shown) is drawn and the whole first layer of the thatch element construction 250 is seamed and placed in position on the slat 205. Subsequently, each layer of the thatch element construction 250 is seamed. However, the each folded thatch component 200 is securely held together to the slat 205 via the binder 220.

In one embodiment of the present invention, the multiple thatch roofing material strips 310, 315 are assembled into the thatch panel 300 in multiple layers of the thatch roofing material strips 310, 315 as illustrated in the FIG. 3. Each thatch roofing material strip 310 is folded to form the triangular slot and the thatch roofing material strip 315 is placed in the triangular slot formed by the thatch roofing material strip 310. The thatch roofing materials 315, 310 are securely held together to the slat 305 via the binder 320. The both ends of the slats 305 of each layer of the multiple layers of the thatch roofing material strips 310, 315 are attached to a pair of parallel spaced bars 325 as illustrated in the FIG. 3.

The thatch roofing material strips 310, 315 are similar to the thatch roofing material strips 210, 215 of FIG. 2A and FIG. 2B, and the slat 305 is similar to the slat 205 of FIG. 2A and FIG. 2B. The binder 320 is similar to the binder 220 of FIG. 2A and FIG. 2B.

In one embodiment of the present invention, a method of producing a thatching material for building construction includes the steps of forming the container assembly by inserting the casting member 165 into the container 105 to form the container assembly, positioning the container assembly between the housing member 160 of the at least one holding member and the support projection member 155 of the at least one holding member, cutting the container 105 to obtain the thatching material strips 210, 215 and creating the counter bend on the thatching material strips 210, 215 to obtain the evenly surfaced thatching material. In operation, the proximal end of the casting member 165 is inserted into the housing member 160 of the at least one holding member. The spring element of the housing member 160 is configured for securely holding the casting member 165. The distal end of the casting member 165 having the threaded bore thereon is threadably engaged to the threaded portion 157 of the support projection member 155 of the at least one holding member. The assembled material is then sewn together using a commercial pedal driven or engine driven sewing machine.

Figure 4:
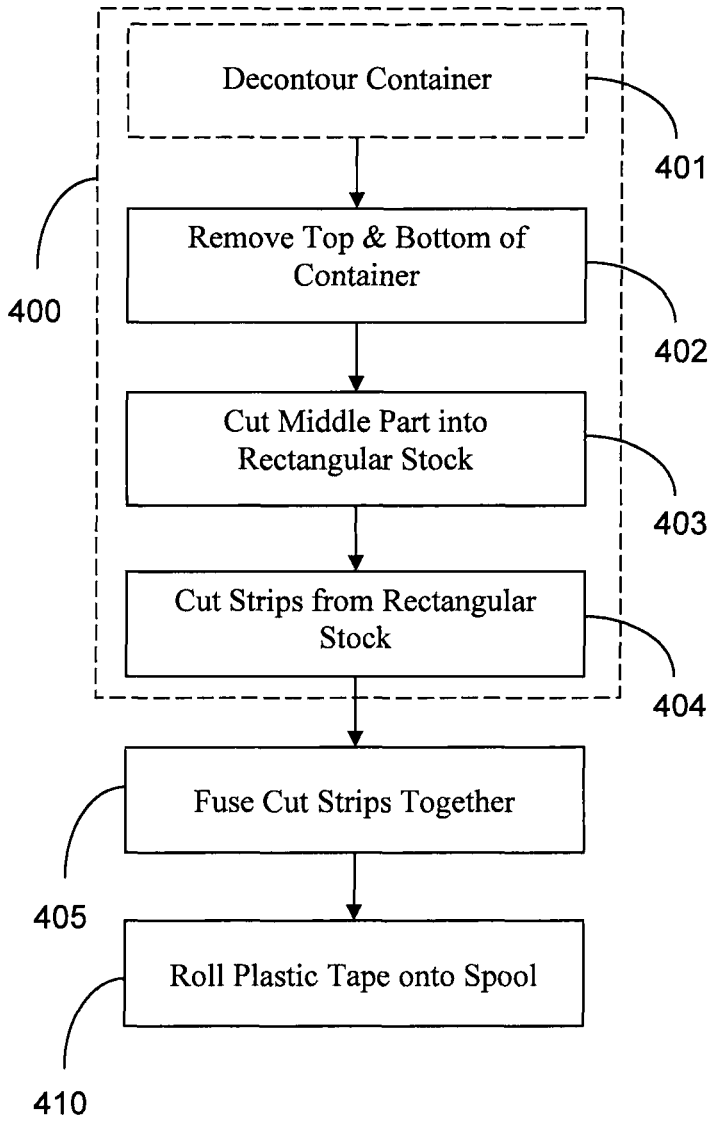
FIG. 4 is a flow chart for a method of creating a plastic tape in accordance with this disclosure.

Referring to FIG. 4, in one embodiment the container 105 or a plurality of containers 105 may be formed into a plastic tape from which slats and thatching material strips may be cut. At step 400, the containers 105 are cut into one or more cut strips. The cut strip may be a spiral strip as described above, and may further be straightened and flattened as described above. Alternatively or in addition, the step 400 of cutting the strips may include decontouring 401 the container 105 if necessary, removing 402 the top part and bottom part of the container 105 to obtain a substantially cylindrical middle part, cutting 403 the middle part longitudinally to obtain a rectangular stock, and cutting 404 the rectangular stock lengthwise into the cut strips. Each of these processes is described in detail, with reference to the Figures, below. Preferably, the cut strips are substantially flat and substantially rectangular in shape, have a uniform width, and may have a uniform or variable length.

At step 405, the cut strips are fused together lengthwise. That is, a first cut strip is fused at its distal end to the proximal end of a second cut strip, a third cut strip is fused at its proximal end to the distal end of the second strip, and so on. The progressive fusing of cut strips creates a plastic tape of substantially uniform length. When a desired length of plastic tape has been created, at step 410 the plastic tape may be rolled onto a spool for easy transport and deployment. Alternatively, the plastic tape may be rolled onto the spool as it is being created.

Figure 5:
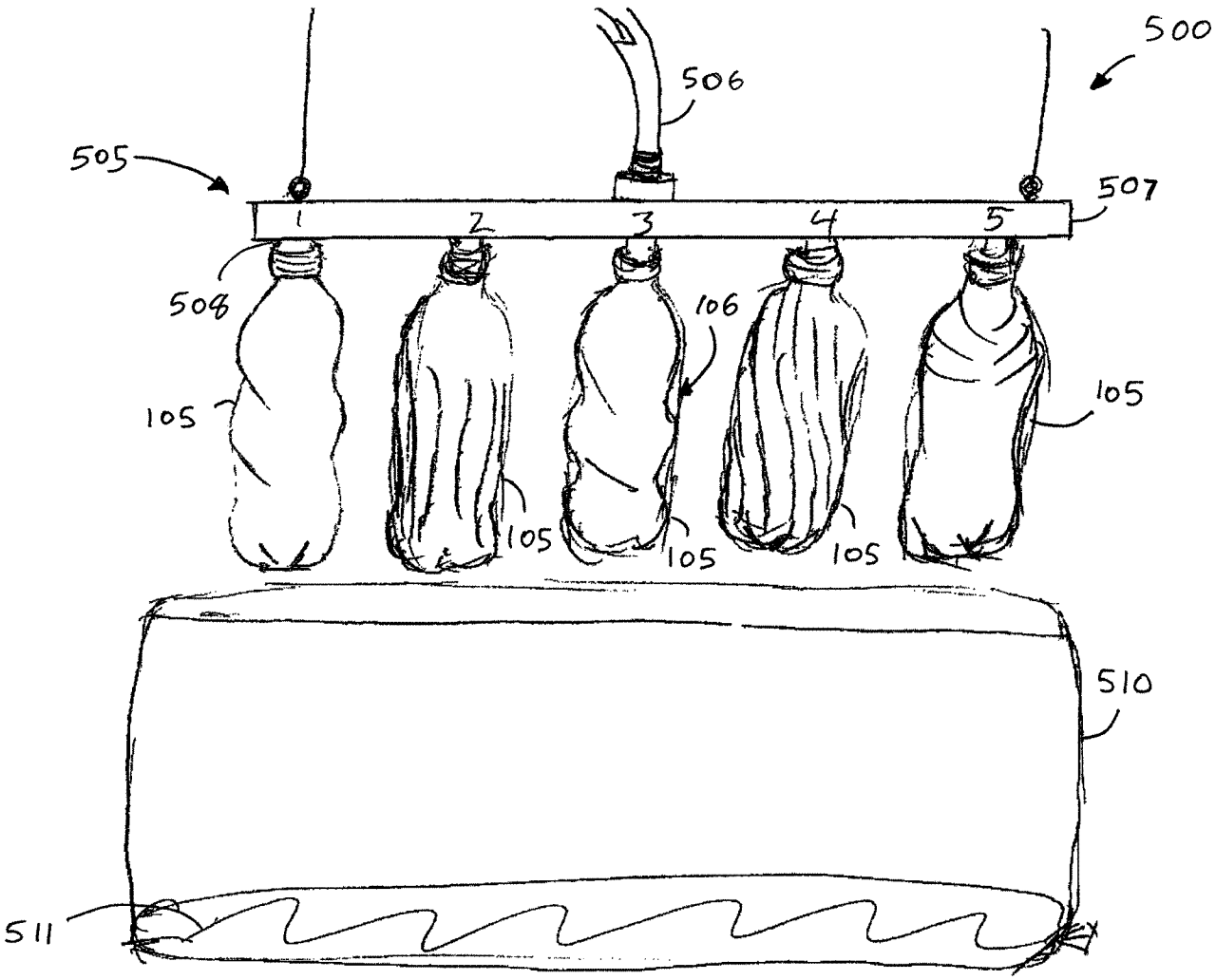
FIG. 5 illustrates a front view of five waste plastic bottles mounted in a decontouring unit in accordance with this disclosure.

A contoured container 105 may require decontouring 401 so that substantially flat cut strips may be obtained from the middle part of the container 105. For example, many waste plastic water bottles have unique ripple- or rib-like concave structures on their outer surfaces to distinguish the water bottle from other companies' water bottles, or to provide some functional improvement to the bottle, such as increases grippability or resistance to collapse. Referring to FIG. 5, these concave structures 106 may be removed from the container 105 by placing the container 105 in a decontouring unit 500. The decontouring unit 500 may comprise a pressurizer 505 in cooperation in a heated bath vessel 510. The pressurizer 505 may be a rigid pipe, a flexible hose, or a combination thereof attached to an air pump (not shown) that blows air through the pressurizer 505. In one embodiment, the pressurizer 505 may comprise a hose 506 attached to a rigid, hollow manifold 507 that comprises one or more mounts 508 upon which one or more containers 105 may be mounted. The pressurizer 505 may be disposed above the vessel 510 in order to lower the containers 105 into a heated bath. Alternatively, the pressurizer 505 may be mounted within the vessel 510. The vessel 510 may be a container for holding a fluid, such as water or propylene glycol, and is connected to a heating element 511 for heating the contained fluid to at least 105 degrees Celsius. The container 105 is attached to the pressurizer 505, such as by securing the mouth of a water bottle over a mount 508, and is submerged in the fluid. The container 105, through the fluid bath, is heated to slightly below its melting point, preferably to about 105 degrees Celsius, so that the container becomes at least partially malleable. Air is then blown through the pressurizer 505 and into the container 105, which blows out the concave structures and creates a substantially smooth surface on the middle part of the container 105. The container 105 may then be removed from the heated bath.

Referring again to FIG. 4, in order to obtain a rectangular stock from the container 105, any contoured top part and bottom part may be removed 402, leaving only the substantially smooth, cylindrical middle part for cutting into the rectangular stock. For example, a typical waste plastic bottle has a top part that tapers to a flanged, threaded mouth for receiving the bottle cap, and further has a contoured bottom part for setting the bottle on a surface. In one embodiment, the tapered top part and contoured bottom part may be removed and separately recycled. When the cylindrical middle part remains, a single longitudinal cut may be made to lay open the cylinder into a substantially flat rectangular stock. Preferably, the longitudinal cut is made with a heated wire or a blade as described above.

Figure 6:
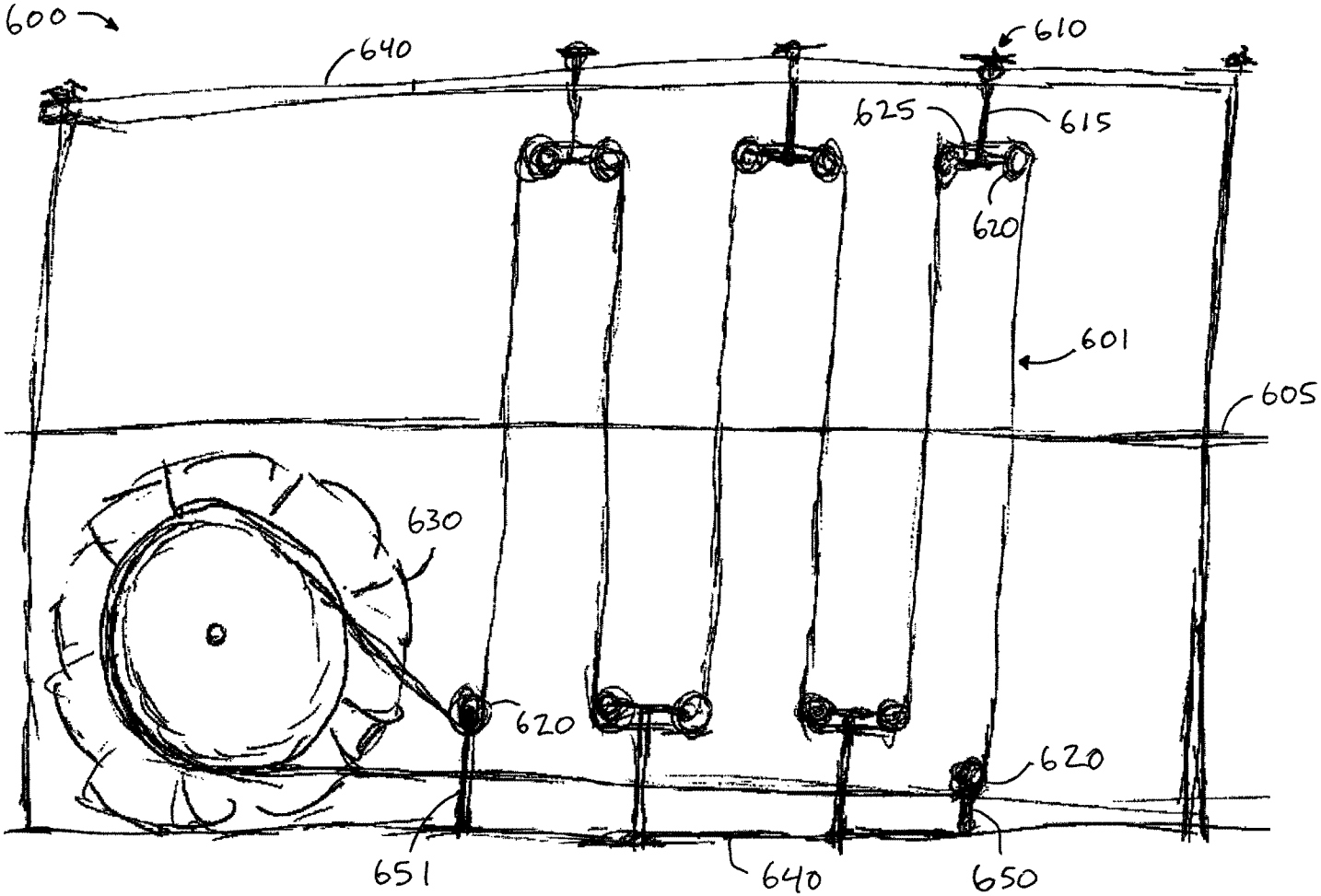
FIG. 6 illustrates a front view of a wire cutter in accordance with this disclosure.

Further cutting 404 of the rectangular stock creates the cut strips for fusing. The rectangular stock may be cut lengthwise a plurality of times to create a plurality of cut strips from a single container 105. In one embodiment, the strips are between one and 1.5 inches thick. By experimentation, it has been shown that this thickness is advantageous to create a substantially thick and water-impermeable roofing thatch that is also durable. Referring to FIG. 6, a wire cutter 600 may be used to create cut strips of substantially uniform width. The wire cutter 600 may comprise a wire 601 mounted on one or more pulleys 610, which are in turn mounted to a support member 640. The wire 601 is substantially vertically oriented to a work surface 605 along which the rectangular stock of the container 105 may be conducted. Preferably, a single wire 601 is mounted on the pulleys 610 to create one or more passes of the wire 601 across the work surface 605, each pass being used to cut the rectangular stock at a point between the other passes of the wire 601. The wire 601 may be further mounted to a rotary motor 630 to drive the wire 601. In the illustrated embodiment, the wire cutter 600 comprises seven pulleys, two of which have a single roller 620 and the remainder having two rollers 620. The single-roller pulleys 650, 651 serve as anchors for the first and last passes of the wire 601. The double-roller pulleys 610 each anchor an upward and a downward pass of the wire 601. The passes of the wire 601 cut up to seven cut strips from a rectangular stock. The width, and correspondingly the number, of cut strips may be changed by providing one or more adjustment mechanisms for the pulleys 610, 650. Suitable adjustment mechanisms include allowing the stem 615 of each pulley 610 to slide along its support member 640, and further allowing the arms 625 on which the rollers 620 are mounted to be extended lengthwise or angled with respect to the stem 615.

Figure 7:
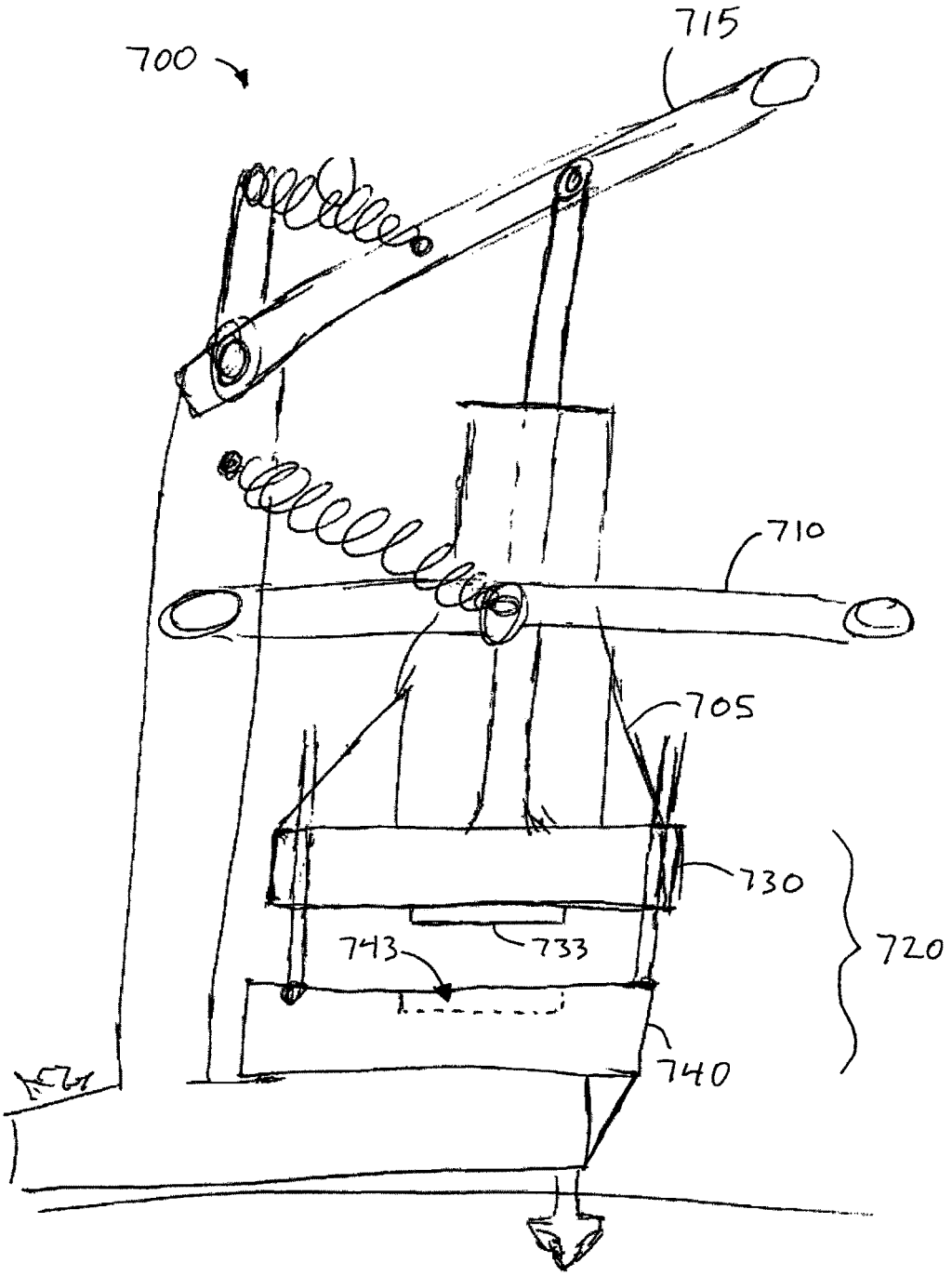
FIG. 7 illustrates a side view of a heated clamp device in accordance with this disclosure.
Figure 8A:
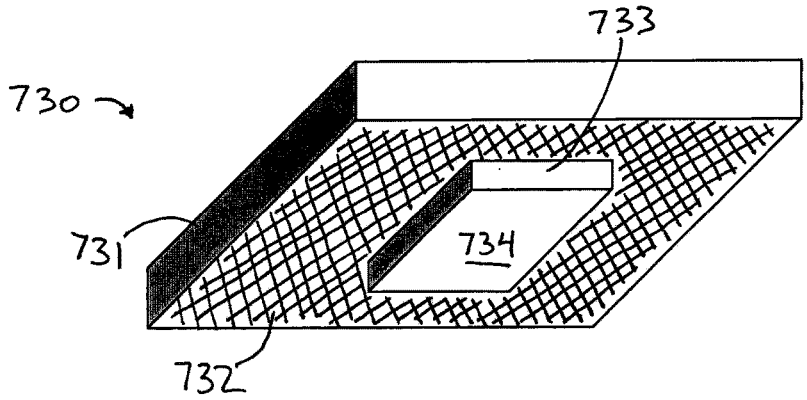
FIGS. 8A and 8B illustrate perspective views of a top plate and a bottom plate, respectively, of the heated clamp device of FIG. 7.
Figure 8B:
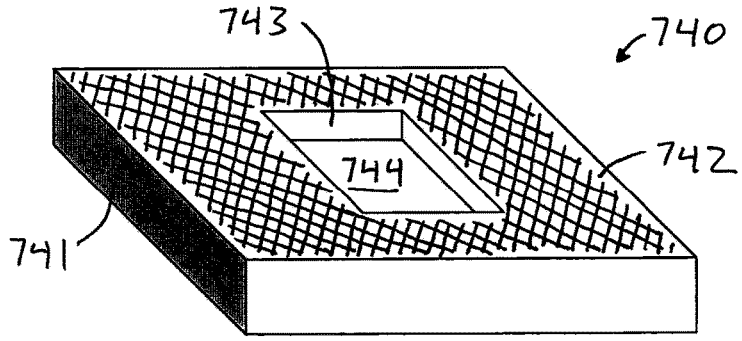
Figure 8C:
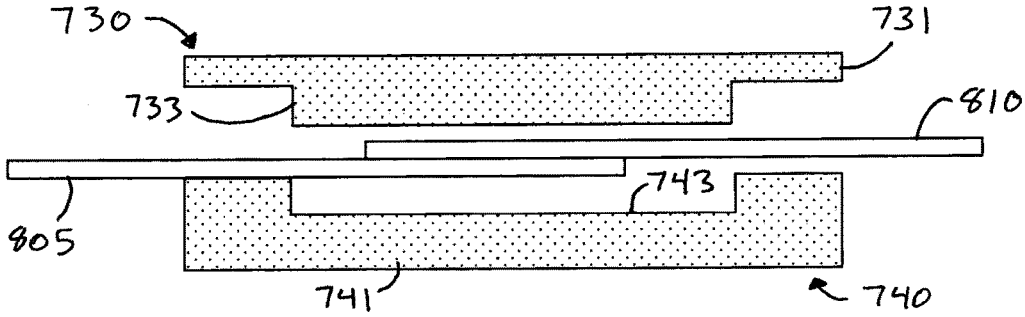
FIG. 8C illustrates a schematic side view of a top plate and bottom plate fusing two cut strips.

The cut strips may be fused lengthwise, or end-to-end, using any suitable device and method for fusing substantially flat plastic strips. Typical means include heating, compression, and sonic welding, among other means. Referring to FIG. 7, a heated clamp 700 may be used to fuse the cut strips. The heated clamp 700 may comprise a clamping mechanism 705 for holding stationary the cut strips to be fused. The clamping mechanism 705 may be any known clamp, such as a vice grip, hinged jaw mechanism, or pincer. The clamping mechanism 705 may be operated by a first lever 710. A second lever 715 operates the fusing mechanism 720. Referring to FIGS. 8A-C, the fusing mechanism 720 may comprise a top plate 730 and a bottom plate 740 that cooperates with the top plate 730 to fuse together two cut strips placed thereon. The top plate 730 may comprise a body 731 having a bottom surface 732 from which a projection 733 extends downwardly. The projection 733 has a contact surface 734 that contacts cut strips 800, 805 placed below the projection 733. The top plate 730 may be partially or completely heated. In one embodiment, the body 731 is made of a conductive ceramic having a nichrome wire (not shown) embedded therein. The nichrome wire serves as the heating element and is attached to a power supply (not shown) for converting electrical energy to thermal energy. In one embodiment, the portion of the bottom surface 732 surrounding the projection 733 may be coated with a non-conductive textured material, so that only the part of the cut strips 800, 805 contacting the projection 733 will be heated.

The bottom plate 740 may comprise a body 741 having a top surface 742 into which a recess 743 is disposed. The recess 743 is sized and positioned to receive the projection 733 of the top plate 730. The recess 743 may have a contact surface 744 that contacts cut strips 800, 805 during operation as described below. The bottom plate 740 may be partially or completely heated. In one embodiment, the body 741 is made of a conductive ceramic having a nichrome wire (not shown) embedded therein. The nichrome wire serves as the heating element and is attached to a power supply (not shown) for converting electrical energy to thermal energy. In one embodiment, the portion of the bottom surface 742 surrounding the recess 743 may be coated with a non-conductive textured material, so that only the part of the cut strips 800, 805 contacting the recess 743 will be heated by the bottom plate 740.

Referring to FIG. 8C, a proximal end of the first cut strip 800 is placed over the recess 743, and a distal end of the second cut strip 805 is placed overlapping the proximal end of the first cut strip 800, over the recess 743. The cut strips 800, 805 are secured in this position with the clamping mechanism 705. When the second lever 715 is pulled, it translates the top plate 730 downward, compressing the cut strips 800, 805 against the bottom plate 740. The overlapping ends of the cut strips 800, 805 are contacted by the contact surface 734 of the projection 733 and pressed into the recess 743. One or both plates 730, 740 are then heated to between about 105 and 106 degrees Celsius, and the heated clamp 700 is held in this position until the cut strips 800, 805 are fused. In one embodiment where only the top plate 730 or bottom plate 740 is heated, the fusion takes about three minutes. In another embodiment where both plates 730, 740 are heated, the fusion takes about 45 seconds. The fusion process is repeated for all cut strips until a plastic tape of a desired length is obtained.

Figure 9:
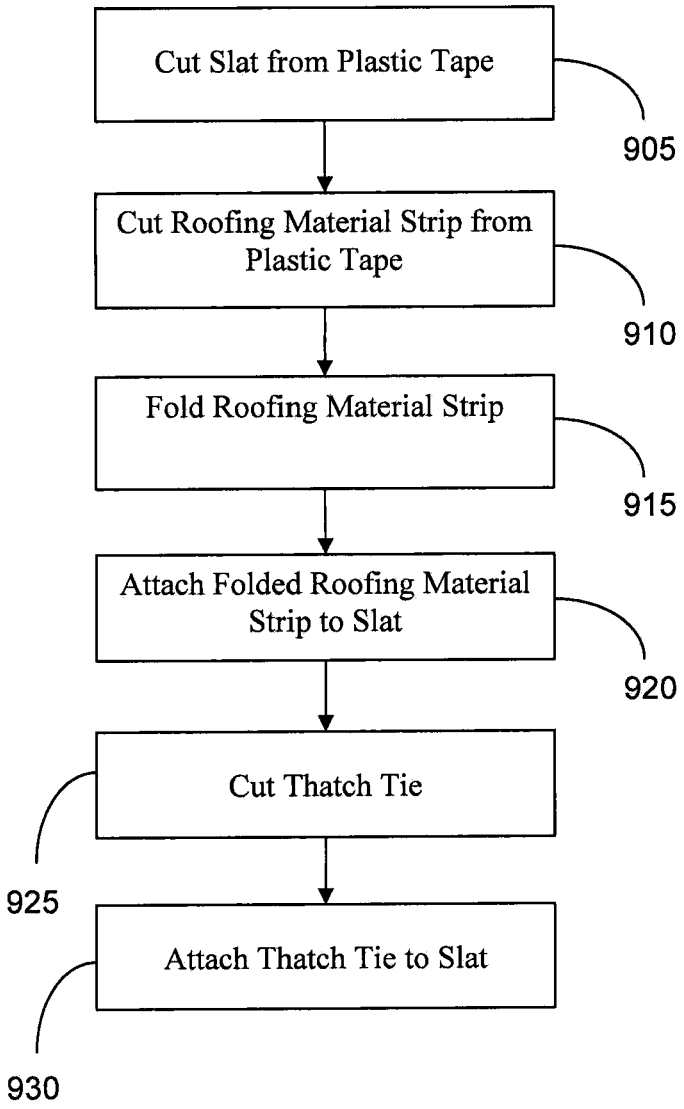
FIG. 9 is a flow chart for a method of making a thatch roofing component from a plastic tape in accordance with this disclosure.
Figure 10:
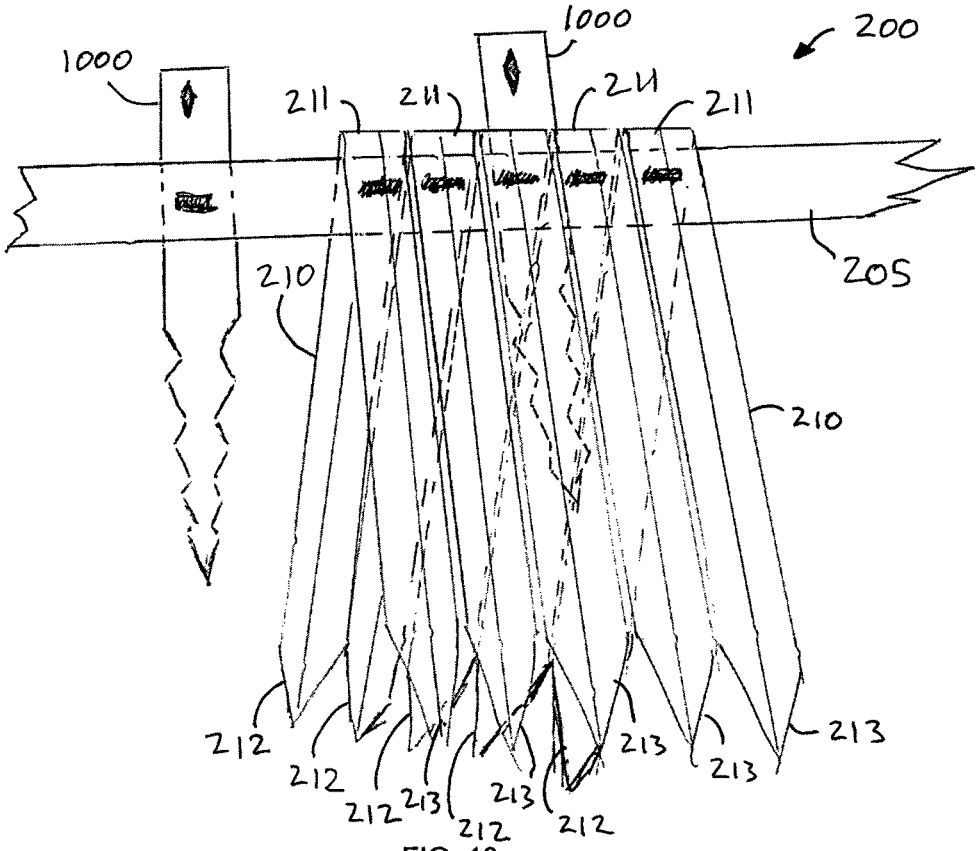
FIG. 10 illustrates a schematic top view of another embodiment of a folded thatch component made from a thatch roofing material strips and mounted on a slat.
Figure 11:
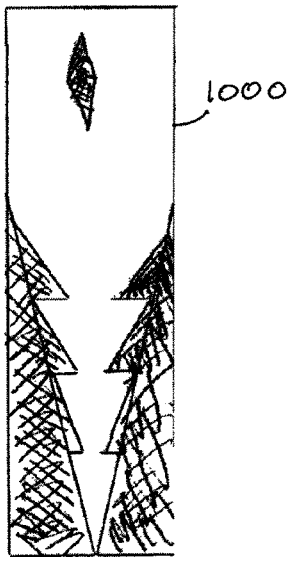
FIG. 11 illustrates a schematic top view of an embodiment of cutting a thatch tie in accordance with this disclosure.

The plastic tape produced as described above may be transported to a remote site, where it may be used to create thatching material as described above. Referring to FIG. 9, at step 905 one or more slats 205 may be cut from the plastic tape by simply cutting the plastic tape at the desired length. At step 910, a plurality of thatch roofing material strips 210 may be cut from the plastic tape. In one embodiment, the thatch roofing material strips 210 may be simply cut at the desired length. The thatch roofing material strips 210 may further be shaped at their ends, such as to form pointed proximal and distal ends as illustrated in FIG. 2A. Preferably, each thatch roofing material strip 210 is about 60 inches long. At step 915, each roofing material strip 210 may be folded. The roofing material strip 210 may be folded as described above with reference to FIG. 2A, or the roofing material strip 210 may be folded once into a V-shape as illustrated in FIG. 10. At step 920, the folded roofing material strips 210 may each be attached to a slat 205 to form a folded thatch component 200. The folded thatch component 200 may be formed using any method of overlapping and attaching the folded roofing material strips 210, 215 as described above. Alternatively, each V-shaped folded roofing material strip 210 may be fused or adhered to the slat 205 as illustrated in FIG. 10, where the roofing material strip 210 is attached to the slat 205 at a point between the fold 211 and the distal end 213 of the roofing material strip 210, and the roofing material strips 210 are attached so the proximal end 212 is behind the slat 205 and the distal end 213 is in front of the slat 205. As shown in FIG. 10, the roofing material strips 210 are attached within about 0.5 inches of each other, providing a water-impermeable overlapping arrangement. At step 925, one or more thatch ties 1000 (see FIG. 10) for tying the folded thatch component 200 to a building structure may be cut from the plastic tape. The thatch tie 1000 may be cut to the desired length and then cut into a serrated tie shape as illustrated in FIG. 11. At step 930, the thatch ties 1000 may be attached to the slat 205 at regular intervals, such as every 6-8 inches.

Therefore, as can be seen, various embodiments of the present disclosure provide an apparatus and method for producing a thatch roofing material for building construction. Particularly, the thatch roofing material is made from waste plastic bottles or containers for building construction. The present invention solves the waste problem created by used containers by using those containers to produce the thatch roofing material. In one embodiment, the present apparatus is very cost effective as the apparatus can be operated without any motor and solely by the rotating mechanism of the crank wheel. Consequently, the apparatus can be utilized in remote areas where electricity is not available and can work efficiently where electricity is very expensive. Moreover, the present apparatus and method do not require skilled labor. In another embodiment, the apparatus can be utilized in urban areas where high volumes of waste plastic bottles are generated, and the bottles can be converted to an easily transportable plastic tape. The plastic tape may then be taken to remote areas where thatch roofing material is needed, and can be assembled into thatch roofing material without the need for skilled labor. Further, the apparatus allows the utilization of any type of container for producing the thatch roofing material for building construction. The apparatus is extremely reliable, requires very little servicing, and can easily be set up and adjusted for different thicknesses and sizes of waste plastic material. The thatch roofing material produced in the present invention is semi-permeable in nature which permits heat accumulated during the day to vent out while providing protection from rain. Further, as the thatch roofing material allows increased day lighting in the building structure it thereby provides improved living conditions in the house.

In the foregoing specification, specific embodiments of the present disclosure have been described. However, one of ordinary skill in the art will appreciate that various modifications and changes can be made without departing from the spirit and scope of the present disclosure as set forth in the various embodiments discussed above and the claims that follow. Accordingly, the specification and figures are to be regarded in an illustrative rather than a restrictive sense, and all such modifications are intended to be included within the scope of the present disclosure. It is to be understood that the disclosure is not to be limited to the exact details of construction, described and shown in the drawings, as obvious modifications and equivalents will be apparent to one skilled in the art. The benefits, advantages, solutions to problems, and any element(s) that may cause any benefit, advantage, or solution to occur or become more pronounced are not to be construed as a critical, required, or essential features or elements as described herein.

What is claimed is:

1. An apparatus for producing a plastic tape, the apparatus comprising:

a decontouring unit configured to produce a substantially smooth surface on a middle part of a waste plastic bottle, wherein the decontouring unit comprises a heated bath vessel and a pressurizer; and a fusing device configured to fuse together at least a first strip and a second strip each being cut from the middle part having the substantially smooth surface.

2. The apparatus of claim 1, wherein the fusing device compresses the first strip and the second strip, disposed in an overlapping position, between first and second contact surfaces at a temperature that fuses the first and second strips.

3. The apparatus of claim 1, further comprising a cutting unit configured to cut the middle part of the waste plastic bottle into a plurality of strips including the first strip and the second strip.

4. The apparatus of claim 3, wherein the cutting unit is a wire cutter.

5. The apparatus of claim 3, wherein the cutting unit cuts a flat rectangular stock produced from the middle part into the plurality of strips.

6. The apparatus of claim 3, wherein the cutting unit cuts the plurality of strips to have a uniform shape.

7. An apparatus for producing a thatch roofing material for building construction, the apparatus comprising:

a decontouring unit configured to produce, from a waste plastic bottle having a contoured middle part, a decontoured middle part having a substantially smooth surface;

a cutting unit configured to cut the decontoured middle part into a plurality of strips having a uniform shape; and a heated clamp configured to fuse together a first strip and a second strip of the plurality of strips, the heated clamp comprising:

a top plate comprising:

a first body having a bottom surface;

a projection extending from the bottom surface of the body, the projection having a substantially planar first contact surface; and a first heating element positioned to heat at least the first contact surface; and a bottom plate disposed a distance below the top plate, the bottom plate comprising:

a second body having a top surface; and a recess disposed in the top surface of the second body and configured to receive the projection of the top plate, the recess having a substantially planar second contact surface that approximates the size of the first contact surface of the top plate, the clamp compressing the first strip and the second strip, disposed in an overlapping position, between the first and second contact surfaces at a temperature that fuses the first and second strips.

8. The apparatus of claim 7 wherein the bottom plate further comprises a second heating element positioned to heat at least the second contact surface of the bottom plate.

9. The apparatus of claim 8 wherein:

the first body and the second body are each conductive ceramic; and the first heating element and the second heating element are each nichrome wire disposed within the first body and the second body, respectively.

10. The apparatus of claim 7 wherein the heated clamp further comprises:

a clamping mechanism that holds the first strip and second strip stationary;

a first lever that operates the clamping mechanism; and a second lever that brings the top plate down into cooperation with the bottom plate such that the projection of the top plate fits into the recess of the bottom plate.

11. The apparatus of claim 10, wherein:

the decontouring unit comprises a heated bath vessel and a pressurizer; and the cutting unit comprises a wire cutter.

12. The apparatus of claim 7, wherein the cutting unit cuts the plurality of strips into rectangles with a uniform width of between about one inch and about 1.5 inches.

13. The apparatus of claim 7, wherein to cut the plurality of strips, the cutting unit is configured to cut a flat rectangular stock produced from the decontoured middle part into the plurality of strips.

* * * * *